US010639534B2

(12) United States Patent
Hartline

(10) Patent No.: US 10,639,534 B2
(45) Date of Patent: May 5, 2020

(54) BASEBALL TEE

(71) Applicant: Hartline Enterprises LLC

(72) Inventor: John Hartline, Sandy, UT (US)

(73) Assignee: Hartline Enterprises LLC, Sandy, UT (US)

( * ) Notice: Subject to any disclaimer, the term of this patent is extended or adjusted under 35 U.S.C. 154(b) by 0 days.

(21) Appl. No.: 15/980,470

(22) Filed: May 15, 2018

(65) Prior Publication Data

US 2019/0351301 A1 Nov. 21, 2019

(51) Int. Cl.
*A63B 69/00* (2006.01)
*A63B 102/18* (2015.01)

(52) U.S. Cl.
CPC ..... *A63B 69/0075* (2013.01); *A63B 69/0002* (2013.01); *A63B 2069/0008* (2013.01); *A63B 2102/18* (2015.10); *A63B 2102/182* (2015.10)

(58) Field of Classification Search
CPC ..... A63B 69/0075; A63B 69/0002; A63B 2069/0008; A63B 2102/18; A63B 2102/182
See application file for complete search history.

(56) References Cited

U.S. PATENT DOCUMENTS 3,967,822 A * 7/1976 Candor ..... A63B 57/10 29/525
5,133,551 A * 7/1992 Handy ..... A63B 59/59 473/567
6,682,445 B1 * 1/2004 Tanner ..... A63B 69/0075 473/417
9,724,582 B2 * 8/2017 Burrell ..... A63B 69/0002
2010/0099520 A1 * 4/2010 Auzoux ..... A63B 67/06 473/417
2014/0364255 A1 * 12/2014 Nelson ..... A63B 69/0075 473/417
2018/0043230 A1 * 2/2018 Gutierrez ..... A63B 69/0075

* cited by examiner

*Primary Examiner* — Jeffrey S Vanderveen
(74) *Attorney, Agent, or Firm* — Kirton McConkie; Brian Turner

(57) ABSTRACT

A batting tee can include a mesh cup. The mesh cup is sufficiently rigid to support a ball but also easily deflects to minimize the impact when the batter strikes the tee. This ability to deflect also prolongs the life of the cup. The batting tee may be in the form of a complete batting tee or may be a component that can be used as a replacement for the cup of an existing batting tee. A set of balls of differing weights may also be provided with the batting tee.

20 Claims, 5 Drawing Sheets

BASEBALL TEE

CROSS-REFERENCE TO RELATED APPLICATIONS

N/A

BACKGROUND

Batting tees are used in baseball, softball and other similar sports to support the ball while it is hit. Batting tees may be used in games by younger players to remove the difficulty of hitting a pitch. Batting tees may additionally be used by players of any age to practice and perfect the player's swing. For example, batting tees allow the ball to be consistently positioned in the same spot to allow the player to practice hitting a particular pitch (e.g., low and away or high and inside).

Various problems exist with batting tees. For example, most batting tees have a hard rubber cup in which the ball is placed. It is common, particularly with younger players, to at least partially hit this cup during the swing. Oftentimes, this results in the batting tee tumbling forward requiring it to be picked up and returned to its desired position. In addition to being a nuisance, the striking of the cup may damage the tee and even cause pain to the batter. Even if the bat only grazes the cup, it may still alter the swing sufficiently to diminish the benefits of practicing of a tee.

BRIEF SUMMARY

The present invention extends to a batting tee that includes a mesh cup. The mesh cup is sufficiently rigid to support a ball but also easily deflects to minimize the impact when the batter strikes the tee. This ability to deflect also prolongs the life of the cup. The batting tee of the present invention may be in the form of a complete batting tee or may be a component that can be used as a replacement for the cup of an existing batting tee. A set of balls of differing weights can also be provided.

In one embodiment, the present invention is implemented as a batting tee that includes: a batting tee top that includes a mesh cup and a post, a top of the mesh cup forming an opening into which a ball can be inserted and supported, a bottom of the mesh cup coupling to a top of the post; one or more additional posts to which the post connects; and a base that supports the one or more additional posts and the batting tee top in a vertical arrangement.

In another embodiment, the present invention is implemented as a batting tee top that comprises a mesh cup having a top and a bottom, and a post having a top and a bottom, the bottom of the mesh cup being secured to the top of the post. The bottom of the post is configured to couple to multiple different sized posts of existing batting tees.

In another embodiment, the present invention is implemented as a batting tee comprising: a batting tee top that includes a mesh cup and a post, a top of the mesh cup forming an opening into which a ball can be inserted and supported, a bottom of the mesh cup including a coupler that inserts into a top of the post to secure the mesh cup to the post; a ring that is adjustably positioned around the mesh cup; one or more additional posts to which the post of the batting tee top connects; and a base that supports the one or more additional posts and the batting tee top in a vertical arrangement.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1A:
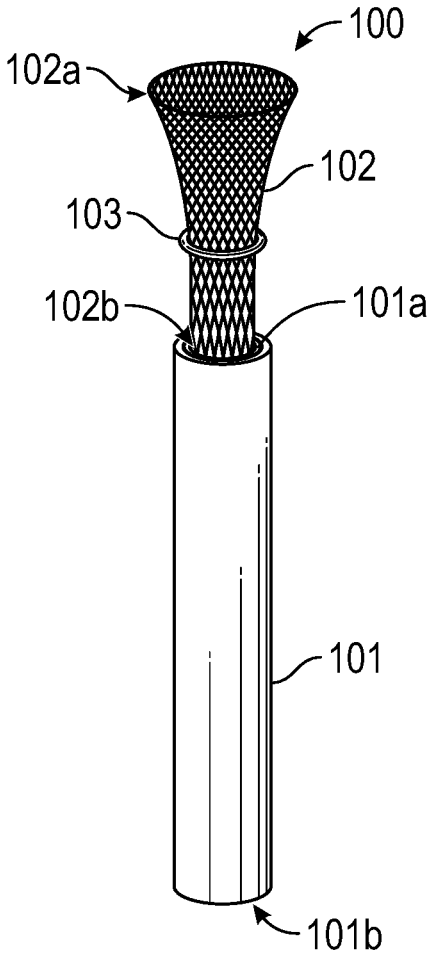
FIG. 1A illustrates a batting tee that includes a mesh cup in accordance with embodiments of the present invention.

FIG. 1 illustrates a batting tee top 100 that is configured in accordance with embodiments of the present invention. Batting tee top 100 includes a post 101, a mesh cup 102 and a ring 103. A bottom 102*b* of mesh cup 102 is configured to couple to a top 101*a* of post 101. In the depicted embodiment, bottom 102*b* of mesh cup 102 inserts into top 101*a* of post 101. However, other configurations could also be employed including, for example, securing bottom 102*b* around top 101*a*.

Figure 1B:
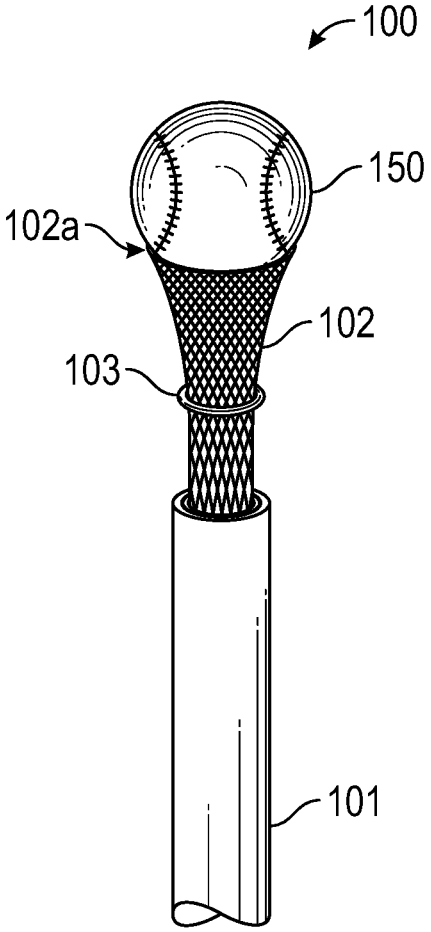
FIG. 1B illustrates the batting tee of FIG. 1A with a ball supported in the mesh cup.

A top 102*a* of mesh cup 102 is configured to receive and support a ball 150 as shown in FIG. 1B. Ball 150 may typically be a baseball or a softball; however, mesh cup 102 could support any appropriately sized ball. Mesh cup 102 may be formed of a woven mesh material such that the cross-sectional diameter of mesh cup 102 will restrict as it is elongated and expand as it is compressed. The mesh material can preferably be folded back overtop of itself to form a double layer of mesh material. The mesh material can be oriented so that the folded seam is positioned at top 102*a* and the two ends are aligned at bottom 102*b*.

Because bottom 102*b* is inserted into (or otherwise secured to) top 101*a* of post 101, the diameter of bottom 102*b* will remain fixed. In contrast, top 102*a* will remain free to expand up to its maximum diameter. To control the diameter of top 102*a*, ring 103 can be placed around mesh cup 102 at a particular distance relative to top 102*a*. For example, to allow top 102*a* to expand to a diameter suitable to receive a softball, ring 103 can be moved downwardly relative to top 102*a*. In contrast, to restrict the diameter of top 102*a* to be suitable to receive a baseball, ring 103 can be moved closer to top 102*a*. The diameter of top 102*a* is therefore inversely proportional to the distance between top 102*a* and ring 103 (or the distance between top 102*a* and top 101*a* if ring 103 is not used).

The doubling of the mesh material ensures that top 102*a* can maintain its diameter while supporting a ball (i.e., it provides vertical rigidity to mesh cup 102). At the same time, the doubling of the mesh material still allows mesh cup 102 to easily deflect in a horizontal direction (e.g., when it is hit by the bat). This ability to deflect in the horizontal direction minimizes the impact on the swing. For example, if a batter strikes mesh cup 102, the bat will experience little to no deflection as a result of striking mesh cup 102 such that the hitting of a pitch is more closely emulated. Additionally, because mesh cup 102 will easily deflect, striking mesh cup 102 will not cause the batting tee to be propelled forward. The mesh material will also be resilient to repeated deflections thereby prolonging the life of the batting tee.

Ring 103 can preferably be formed of an elastomeric material to minimize the impact if it is struck by the bat. For example, ring 103 can be formed of a deformable rubber material. The inner diameter of ring 103 may be substantially the same as the inner diameter of top 101*a* of post 101. Therefore, ring 103 can be used to control the distance between top 102*a* and the point at which the diameter of mesh cup 102 commences to increase. As mentioned above, this distance controls how large the diameter (or opening) of top 102*a* will be.

Figure 2:
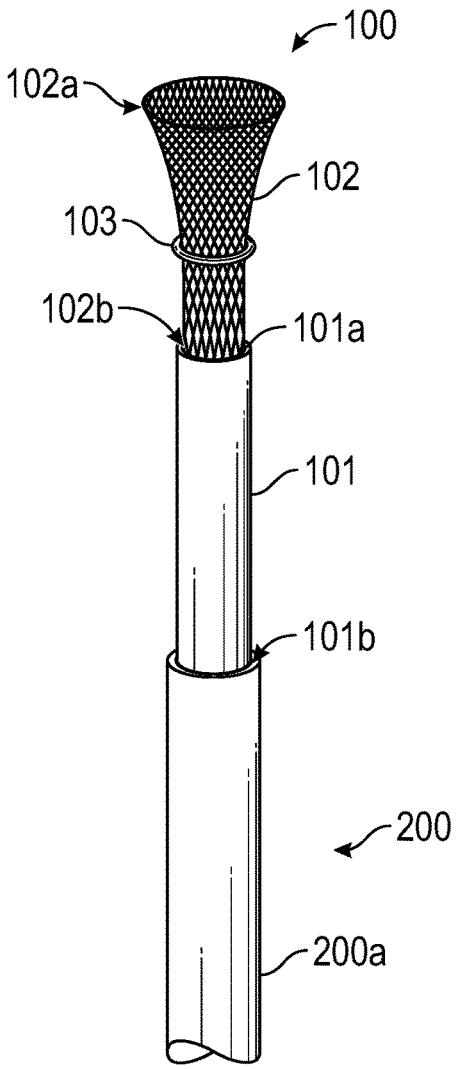
FIG. 2 illustrates an embodiment of a batting tee that includes a mesh cup and a telescoping post assembly.
Figure 3:
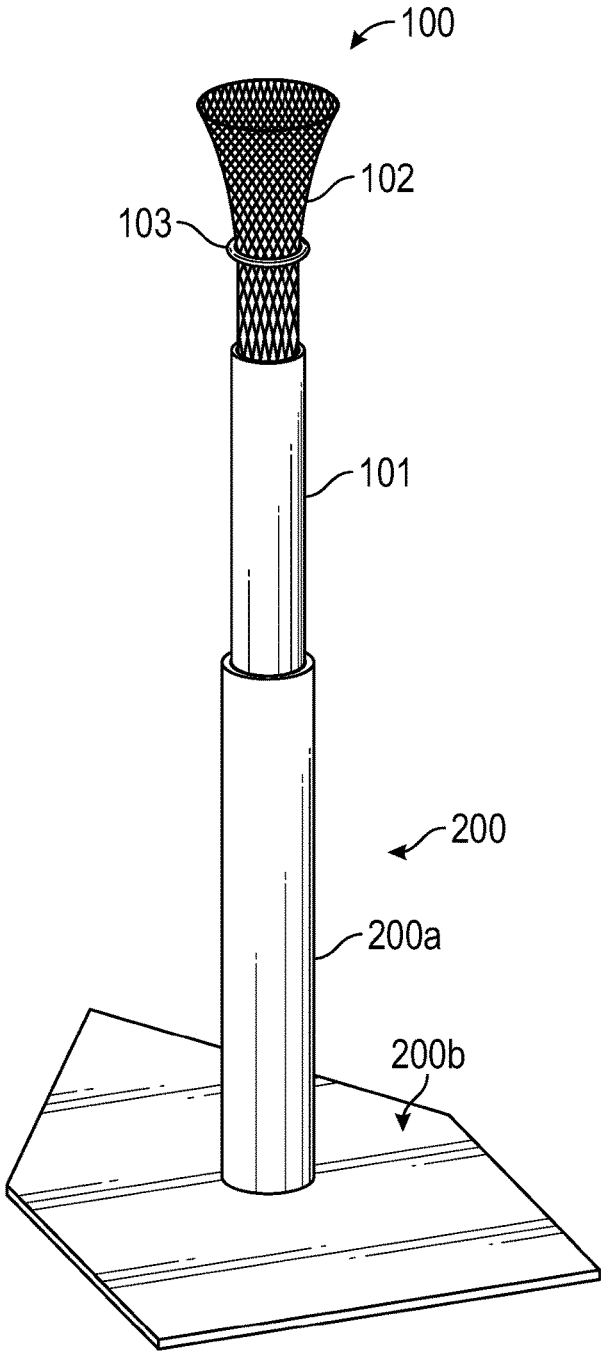
FIG. 3 illustrates an embodiment of a batting tee that includes a mesh cup, a telescoping post assembly and a base.

FIG. 2 illustrates an embodiment where batting tee top 100 forms part of a telescoping post assembly 200. Telescoping post assembly 200 includes post 101, which functions as an upper post, and a lower post 200*a* into which bottom 101*b* of post 101 inserts. FIG. 3 illustrates an embodiment where telescoping post assembly 200 is coupled to a base 200*b* thereby forming a complete batting tee. In this embodiment, lower post 200*a* is coupled to base 200*b* in a vertical orientation. In both FIGS. 2 and 3, post 101 can be configured to slide within (or relative to) lower post 200*a* so that the height of mesh cup 102 can be adjusted for a particular batter or scenario. Any suitable interface can be employed between post 101 and lower post 200*a* to allow them to telescope. For example, the outer diameter of post 101 may be slightly larger than the inner diameter of lower post 200*a* (at least at the top of lower post 200*a*) or vice versa such that a friction fit is formed. Post 101 and lower post 200*a* may be formed of a rubber or similar material that will restrict movement between post 101 and lower post 200*a* so that their relative positions will not adjust unintentionally.

Figure 4:
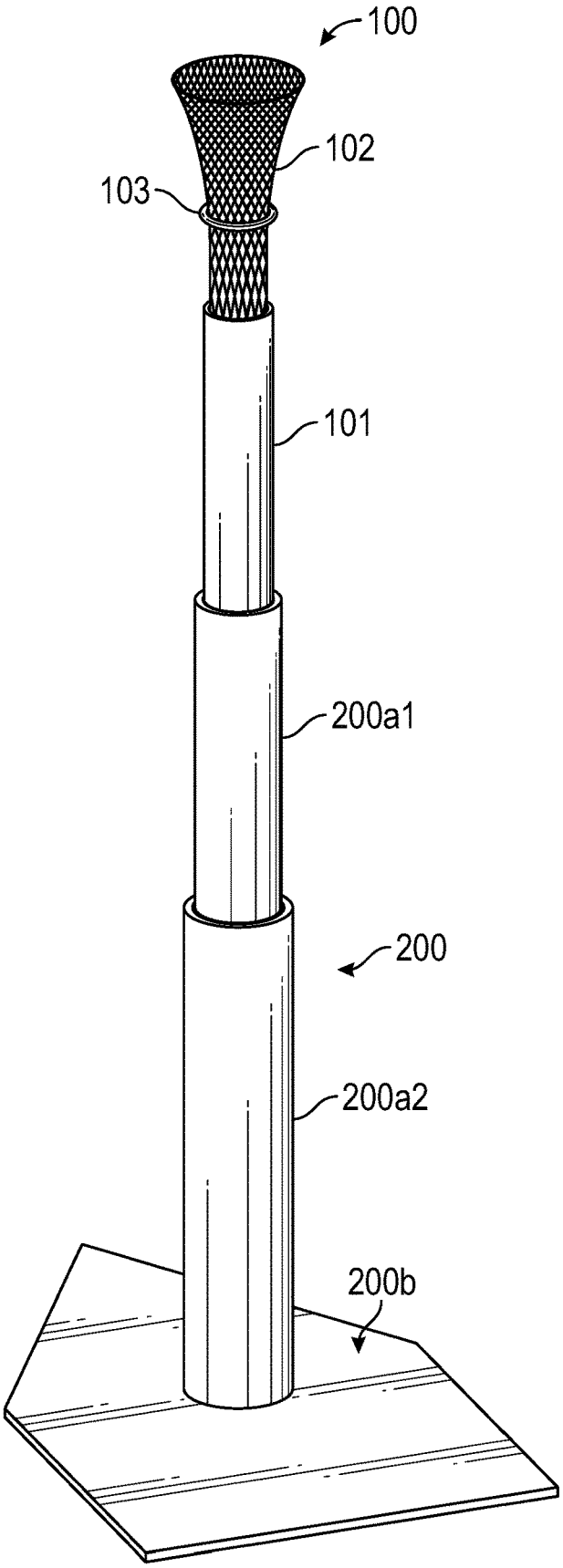
FIG. 4 illustrates how the batting tee of FIG. 1A can be used on an existing batting tee.

FIG. 4 illustrates an embodiment where telescoping post assembly 200 includes post 101, an intermediate post 200*a*1, and a bottom post 200*a*2 connected to base 200*b*. In such embodiments, post 101 may be configured to slide relative to intermediate post 200*a*1 and/or intermediate post 200*a*1 may be configured to slide relative to bottom post 200*a*2. In other words, the embodiment of FIG. 4 may provide one or two points of adjustability to the height of mesh cup 102.

In FIGS. 2-4, the combination of lower post 200*a* and base 200*b* and the combination of intermediate post 200*a*1, bottom post 200*a*2 and base 200*b* may either be components of an existing batting tee to which batting tee top 100 is added or components of a new batting tee which also includes batting tee top 100. In other words, batting tee top 100 can be provided as a separate component that can be retrofitted to an existing tee.

As described in the background, many existing batting tees wear out over time due largely to damage that is caused when the tee is struck during a swing. Prior to the present invention, such batting tees would typically be discarded and replaced. However, with the present invention, batting tee top 100 can simply be added in place of the damaged top of the existing tee to avoid having to purchase an entire new tee.

Figure 5:
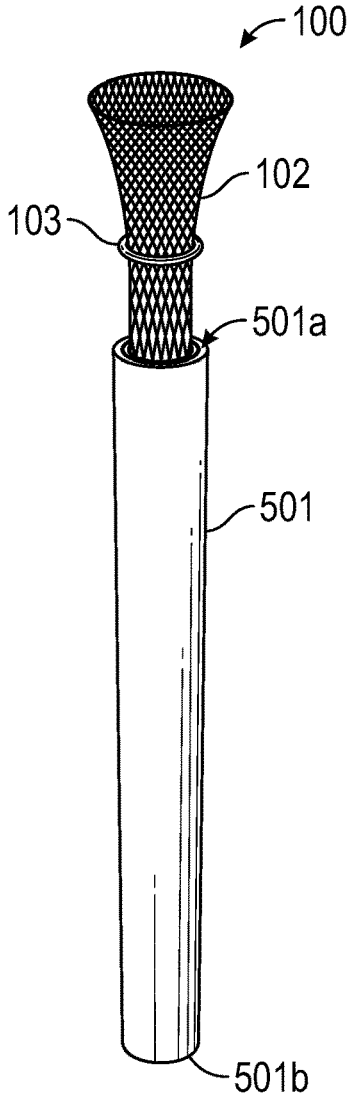
FIG. 5 illustrates an example of how the post of the batting tee of FIG. 1A can be configured to allow it to be used on various types of existing batting tees.

Various configurations of post 101 can be employed to enable batting tee top 100 to be used on a wide variety of existing batting tees. For example, FIG. 5 shows an embodiment where post 101 is replaced with a post 501 having an outer diameter that tapers from a top 501*a* to a bottom 501*b*. As described above, mesh cup 102 can couple to top 501*a* while bottom 501*b* can insert into a post of an existing batting tee (e.g., into lower post 200*a* or into intermediate post 200*a*1). The tapered outer diameter of post 501 ensures that post 501 can be used with existing batting tees having posts with varying diameters. In particular, bottom 501*b*, which has a smaller diameter, can be inserted into the top of the posts of many different inner diameters. Post 501 can then be forced farther into the existing post until the outer diameter of post 501 matches the inner diameter of the existing post. Although such a design may not allow post 501 to be substantially adjusted relative to the existing post, if the existing post is an intermediate post (e.g., as shown in FIG. 4), the height of mesh cup 102 may still be adjusted by sliding the intermediate post relative to the bottom post. It is noted that post 501 could alternatively be configured with an upwardly tapered inner diameter to allow the existing post to insert into post 501.

Figure 6:
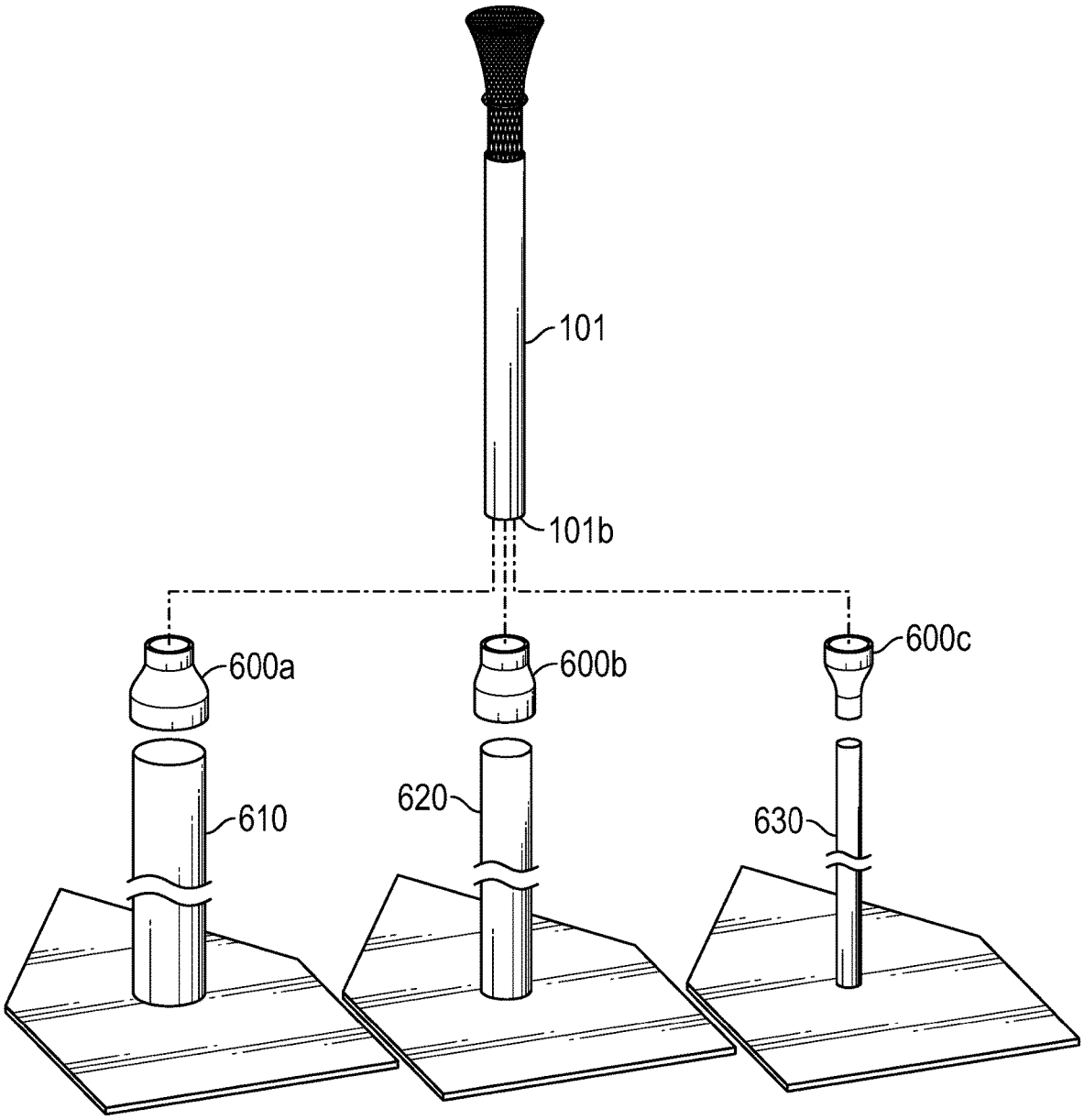
FIG. 6 illustrates various adapters that the batting tee of FIG. 1A can include to allow it to be used on various types of existing batting tees.

FIG. 6 provides another example of how batting tee top 100 can be coupled to a wide variety of existing batting tees. In this embodiment, post 101 can have (but need not have) a fixed outer diameter and can include a number of adapters each of which enables post 101 to be coupled to an existing post having a particular diameter. For example, in FIG. 6, adapters 600*a*-600*c* each have a top end that matches the outer diameter of bottom 101*b* of post 101 and a bottom end with a different sized outer diameter corresponding to a particular type of existing batting tee. Adapter 600*a* is sized to allow post 101 to be coupled to a large diameter post 610 of an existing batting tee, adapter 600*b* is sized to allow post 101 to be coupled to a medium diameter post 620 of an existing batting tee, and adapter 600*c* is sized to allow post 101 to be coupled to a small diameter post 630 of an existing batting tee. Posts 610, 620, and 630 may represent either an intermediate post or a lower/bottom post of an existing batting tee. Also, adapters 600*a*-600*c* could alternatively be configured with bottom ends that insert into the existing post rather than around the existing post. Similarly, the top end of adapters 600*a*-600*c* could be configured to insert into post 101.

Figure 7:
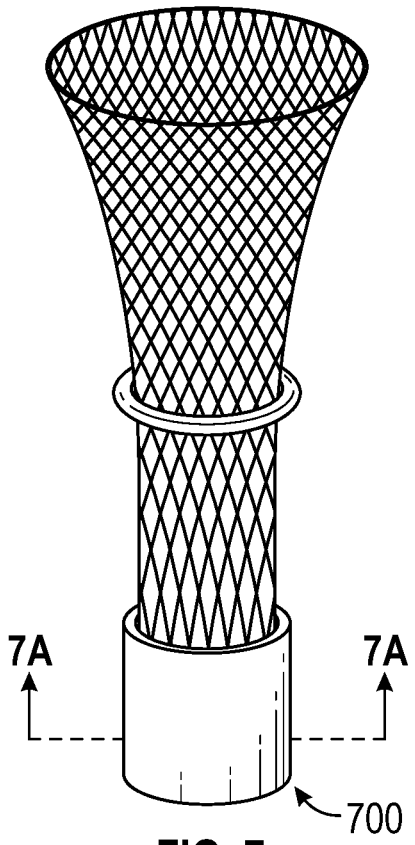
FIG. 7 illustrates a mesh cup that includes a coupler.
Figure 7A:
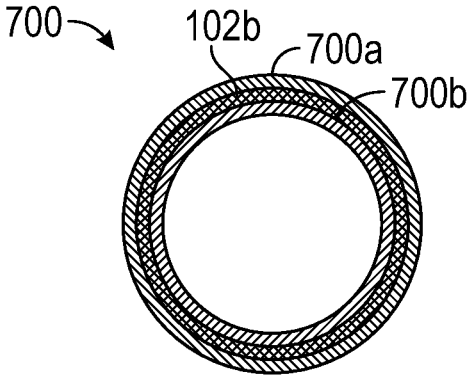
FIG. 7A illustrates a cross-sectional view of the mesh cup of FIG. 7 taken through the coupler.

FIGS. 7 and 7A illustrate an example of how mesh cup 102 can be secured to post 101. As shown, a coupler 700 can be secured to bottom 102*b* of mesh cup 102. An outer diameter of coupler 700 can be slightly larger than an inner diameter of top 101*a* of post 101. Post 101 can be formed of a rubber or other elastomeric material that will compress around coupler 700 when it is inserted into post 101. In this way, mesh cup 102 will be held securely to post 101 while still being removable from or adjustable within post 101. This may also allow mesh cup 102 to be replaced in batting tee top 100.

FIG. 7A illustrates one possible configuration of coupler 700. In this example, coupler 700 includes an outer cylinder 700*a* and an inner cylinder 700*b*. The inner diameter of outer cylinder 700*a* can substantially match the outer diameter of inner cylinder 700*b* so that bottom 102*b* of mesh cup 102 can be sandwiched between the two cylinders. In some embodiments, the inner diameter of outer cylinder 700*a* and the outer diameter of inner cylinder 700*b* may be tapered upwardly so that a tighter interface is formed as inner cylinder 700*b* is inserted upwardly inside outer cylinder 700*a*. In such cases, outer cylinder 700*a* may first be placed around bottom 102*b* and then inner cylinder 700*b* can be inserted through bottom 102*b* within outer cylinder 700*a*. The tapering of the cylinders' diameters will facilitate this assembly process. To reinforce the coupling between outer and inner cylinders 700*a*/700*b* and to maintain bottom 102*b* between the two cylinders, an adhesive, welding, or other technique can be employed. For example, sonic welding can be performed to cause bottom 102*b* to adhere to outer and inner cylinders 700*a*/700*b*.

In some embodiments, a batting tee as described above may also include a set of balls of differing weights. Even with the reduction in resistance and contact shock that the batting tee provides, some individuals and especially children may still experience pain when hitting the ball. This may be the case even when the bat only contacts the ball. Because of the pain, such individuals may be reluctant to swing.

To address such concerns, the batting tee of the present invention can include multiple balls ranging in weight. In particularly, a number of balls that are lighter than a traditional baseball can be included in the set to allow an individual that is learning to swing to use the lighter balls first. In this way, the individual will initially experience less pain or shock when swinging. As the individual progresses, he or she can use the increasingly heavier balls until ultimately reaching the standard-weight baseball. A set of softballs ranging in weights could also or alternatively be provided. By minimizing the shock of striking the ball, the combination of the batting tee and the balls of differing weights can encourage individuals to swing the bat properly and without reluctance.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A batting tee comprising:

a batting tee top that includes:

a mesh cup having a top and a bottom, the top of the mesh cup forming an opening into which a ball can be inserted and supported;

a coupler that comprises an outer cylinder and an inner cylinder, wherein the bottom of the mesh cup inserts between the outer cylinder and the inner cylinder to thereby secure the mesh cup to the coupler; and a post having a top and a bottom, wherein the outer and inner cylinders of the coupler insert into and are positioned within the top of the post such that the bottom of the mesh cup that inserts between the outer cylinder and the inner cylinder also inserts into and is positioned within the top of the post to thereby secure the mesh cup to the post;

one or more additional posts to which the post connects; and a base that supports the one or more additional posts and the batting tee top in a vertical arrangement.

2. The batting tee of claim 1, wherein the bottom of the mesh cup is adhered to the outer and inner cylinders.

3. The batting tee of claim 1, further comprising:

a ring that is positioned around the mesh cup and configured to slide between the top and bottom of the mesh cup to thereby change a diameter of the opening.

4. The batting tee of claim 1, wherein the mesh cup is formed of a mesh material that is folded to form a double layer of mesh material, wherein ends of the mesh material are positioned at the bottom of the mesh cup.

5. The batting tee of claim 1, wherein an inner diameter of the outer cylinder and an outer diameter of the inner cylinder are tapered upwardly.

6. The batting tee of claim 1, wherein an outer diameter of the outer cylinder is larger than an inner diameter of the top of the post to thereby cause the coupler to be compressed within the top of the post.

7. The batting tee of claim 1, wherein the bottom of the mesh cup is adhered to the outer and inner cylinders via sonic welding.

8. The batting tee of claim 1, wherein the one or more additional posts comprise an intermediate post to which the post is connected and a bottom post to which the intermediate post is connected, the bottom post being connected to the base.

9. The batting tee of claim 1, wherein the post and the one or more additional posts form a telescoping post assembly.

10. The batting tee of claim 1, further comprising:

a set of balls, each ball having a different weight.

11. A batting tee top comprising:

a mesh cup having a top and a bottom, the top of the mesh cup forming an opening into which a ball can be inserted and supported;

a coupler to which the bottom of the mesh cup is secured;

a post having a top and a bottom, wherein the coupler is coupled to the top of the post to thereby secure the mesh cup to the post;

a first adapter having a top end of a first size that matches a size of the bottom of the post to thereby allow the first adapter to be coupled to the bottom of the post, the first adapter also having a bottom end of a second size, different from the first size, that matches a size of a first existing post of a first existing batting tee to thereby allow the bottom end of the first adapter to be coupled to the first existing post of the first existing batting tee while the top end of the first adapter is coupled to the bottom of the post; and a second adapter having a top end of the first size that matches the size of the bottom of the post to thereby allow the second adapter to be coupled to the bottom of the post, the second adapter also having a bottom end of a third size, different from the first and second sizes, that matches a size of a second existing post of a second existing batting tee to thereby to allow the bottom end of the second adapter to be coupled to the second existing post of the second existing batting tee while the top end of the second adapter is coupled to the bottom of the post.

12. The batting tee top of claim 11, wherein the coupler comprises an outer cylinder and an inner cylinder, wherein the bottom of the mesh cup inserts between the outer cylinder and the inner cylinder to thereby secure the mesh cup to the coupler.

13. The batting tee top of claim 12, wherein the bottom of the mesh cup is adhered to the outer and inner cylinders.

14. The batting tee top of claim 12, wherein an inner diameter of the outer cylinder and an outer diameter of the inner cylinder are tapered upwardly.

15. The batting tee top of claim 11, wherein the coupler inserts into the top of the post.

16. The batting tee top of claim 11, further comprising:

a third adapter having a top end of the first size that matches the size of the bottom of the post to thereby allow the third adapter to be coupled to the bottom of the post, the third adapter also having a bottom end of a fourth size, different from the first, second and third sizes, that matches a size of a third existing post of a third existing batting tee to thereby to allow the bottom end of the third adapter to be coupled to the third existing post of the third existing batting tee while the top end of the third adapter is coupled to the bottom of the post.

17. The batting tee top of claim 11, further comprising:

a set of balls, each ball having a different weight.

18. The batting tee top of claim 12, wherein the bottom of the mesh cup is adhered to the outer and inner cylinders via sonic welding.

19. The batting tee top of claim 11, further comprising:

a ring that is positioned around the mesh cup and configured to slide between the top and bottom of the mesh cup to thereby change a diameter of the opening.

20. A batting tee comprising:

a batting tee top that includes:

a mesh cup having a top and a bottom, the top of the mesh cup forming an opening into which a ball can be inserted and supported;

a coupler that comprises an outer cylinder and an inner cylinder, wherein the bottom of the mesh cup inserts between the outer cylinder and the inner cylinder to thereby secure the mesh cup to the coupler; and a post having a top and a bottom, wherein the outer and inner cylinders of the coupler insert into and are positioned within the top of the post such that the bottom of the mesh cup that inserts between the outer cylinder and the inner cylinder also inserts into and is positioned within the top of the post to thereby secure the mesh cup to the post;

a ring that is positioned around the mesh cup and configured to slide between the top and bottom of the mesh cup to thereby change a diameter of the opening;

one or more additional posts to which the post of the batting tee top connects; and a base that supports the one or more additional posts and the batting tee top in a vertical arrangement.

* * * * *